United States Patent [19]

Churchill et al.

[11] Patent Number: 5,003,948

[45] Date of Patent: Apr. 2, 1991

[54] STEPPER MOTOR THROTTLE CONTROLLER

[75] Inventors: Jonathan D. Churchill; William T. Volmary, both of Sheboygan, Wis.

[73] Assignee: Kohler Co., Kohler, Wis.

[21] Appl. No.: 538,289

[22] Filed: Jun. 14, 1990

[51] Int. Cl.[5] ..... F02D 11/10; F02D 31/00

[52] U.S. Cl. ..... 123/352; 123/361; 123/399

[58] Field of Search ..... 123/361, 399, 589, 352

[56] References Cited

U.S. PATENT DOCUMENTS

| | | | |
|---|---|---|---|
| 4,052,968 | 10/1977 | Hattori et al. | 123/589 X |
| 4,153,021 | 5/1979 | Hattori et al. | 123/440 |
| 4,546,736 | 10/1985 | Moriya et al. | 123/179 G |
| 4,660,520 | 4/1987 | Inoue et al. | 123/399 |
| 4,760,826 | 8/1988 | Fujita et al. | 123/399 |
| 4,773,370 | 9/1988 | Koshizawa et al. | 123/357 |
| 4,787,353 | 11/1988 | Ishikawa et al. | 123/399 |
| 4,823,749 | 11/1989 | Eisenmann et al. | 123/399 |
| 4,860,708 | 8/1989 | Yamaguchi et al. | 123/399 |

FOREIGN PATENT DOCUMENTS 58-176442 10/1983 Japan .

*Primary Examiner*—Tony M. Argenbright
*Attorney, Agent, or Firm*—Quarles & Brady

[57] ABSTRACT

A throttle controller for an internal combustion engine employs a stepper motor to move the throttle valve and provides a controller to permit the use of the stepper motor. The stepper motor requires no return spring or position sensor and hence offer weight and cost advantages. The throttle position is deduced by means of an up-down counter tracking movement of the stepper motor during throttle control. The controller includes an integration means to accommodate the unknown starting throttle position. A fuel cutoff solenoid is activated in the event of over-speed or power loss. An engine speed signal for the controller is produced by a variable reluctance sensor providing a signal to a slope detector circuit to eliminate the influence of external magnetic fields.

8 Claims, 4 Drawing Sheets

FIG. 3
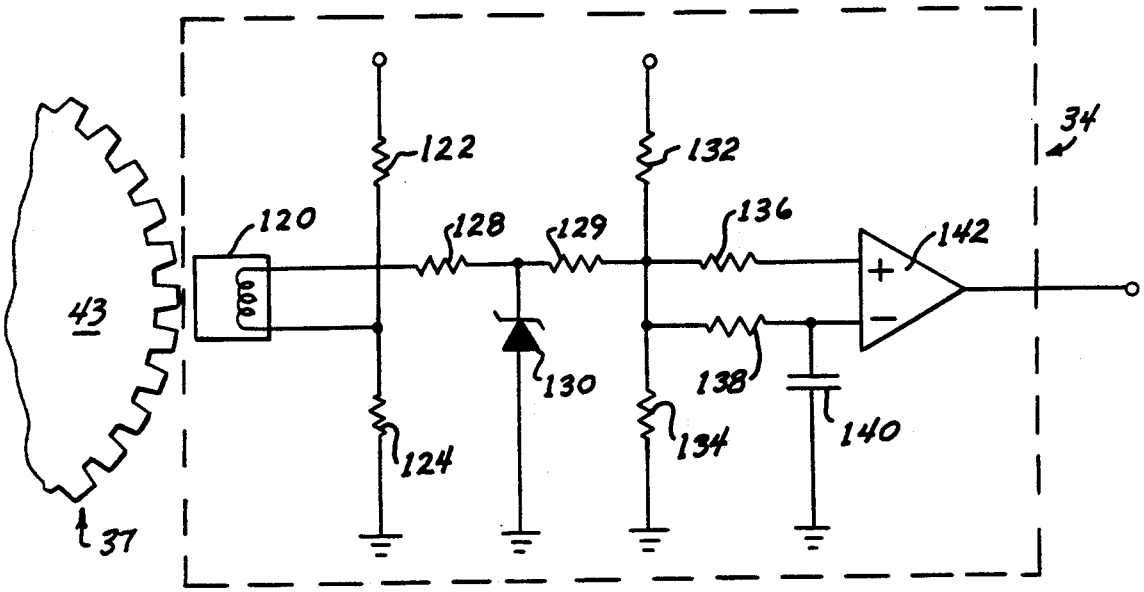
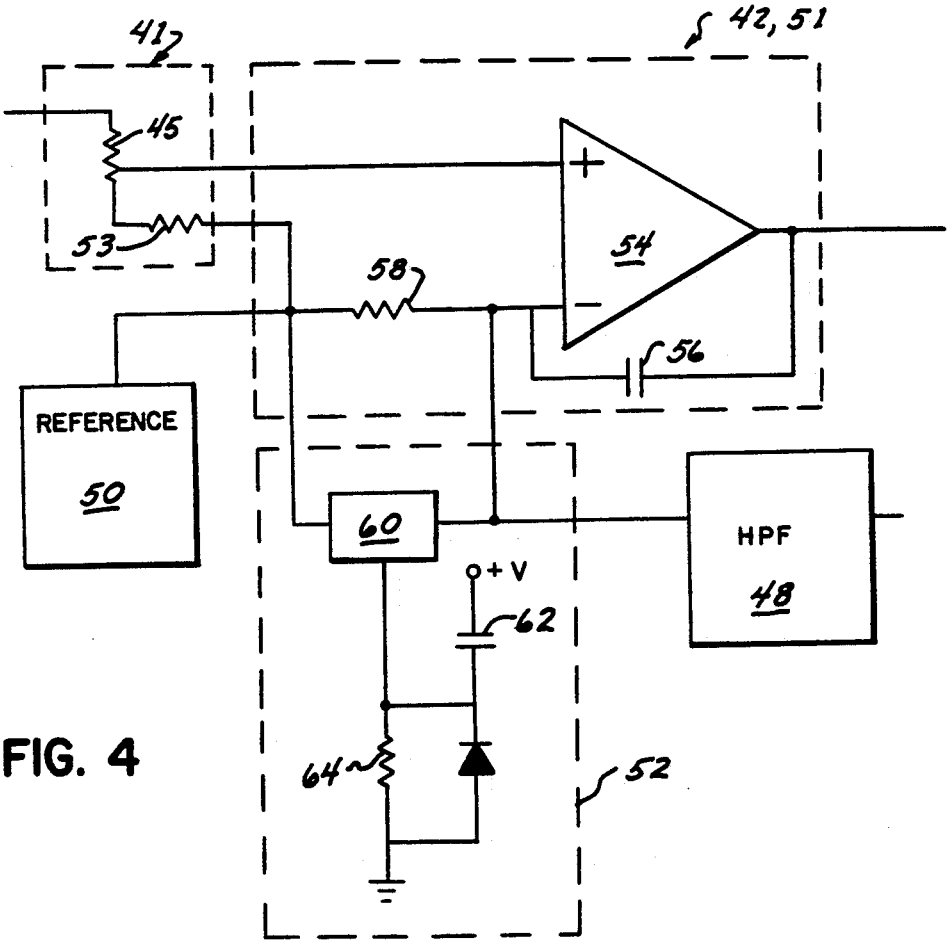
FIG. 4

STEPPER MOTOR THROTTLE CONTROLLER

BACKGROUND OF THE INVENTION

1. Field of the Invention

The invention relates to internal combustion engine controllers and in particular to an engine speed controller employing an electro-mechanical actuator.

2. Background of the Art

The precise speed control of internal combustion engines is desired for many applications but is particularly important when such engines are used to drive AC generators. The speed of the engine determines the frequency of the generated power and many AC powered electrical devices require accurately regulated frequency. In addition, this accurate speed control must be maintained under rapid load variations which may result from nearly instantaneous changes in the consumption of electrical power from the generator. Variation in engine speed with change in engine load is termed "droop".

Engine speed control may be performed by a number of methods. A mechanical governor may sense the rotational speed of the engine and open or close the throttle to regulate the engine speed in response to imputed load changes. Such mechanical control has the advantage of being relatively inexpensive, but may allow substantial droop during normal load variations.

More sophisticated engine speed control may be realized by sensing engine speed electrically and using an an electromechanical actuator connected to the throttle to change the throttle position. Typically, the electromechanical actuator is a linear or rotary actuator. As the names imply, a linear actuator has a control shaft which extends from the body of the actuator and moves linearly by a distance proportional to the magnitude of a current or voltage applied to the actuator. A rotary actuator has a shaft which rotates by an angle proportional to the magnitude of the applied current or voltage. In both actuators, a spring returns the shaft to a zero or "home" position when no voltage or current is applied to the actuator. The power consumed by these actuators is increased by this return spring whose force must be constantly overcome.

The power required by the use of a return spring increases the cost and weight of a throttle control using a linear or rotary actuator. For this reason, it is known to use a bidirectional stepper motor in place of a linear or rotary actuator for the purpose of electronic engine control.

A bidirectional stepper motor is an electro-mechanical device that moves a predetermined angular amount and direction in response to the sequential energizing of its windings. With such a bidirectional stepper motor, the return spring may be omitted or made weaker allowing the use of a smaller motor with equivalent or better dynamic properties than the linear or rotary actuators.

The use of a lower powered bidirectional stepper motor typically requires that a position sensing device be attached directly to the throttle. The reason for this is that the stepper motor may have a arbitrary orientation when its power is first applied and hence the position sensing device is necessary to provide an absolute indication of the throttle position. Such position sensing devices add complexity to the throttle and increase its cost.

SUMMARY OF THE INVENTION

The present invention employs a counter to create a virtual throttle position that may be used in a control loop in lieu of actual position feedback. Specifically, a oscillator produces a periodic clock signal which feeds a sequencer. The sequencer also receives a direction signal which together with the periodic clock signal instructs the sequencer to move a stepper motor attached to a throttle in an indicated direction for a predetermined number of steps. An up/down counter also receives the direction and clock signal and produces a digital word updated in the direction indicated by the direction signal and clocked by the clock signal. This digital word is compared to an electric throttle control signal by a comparator to produce the direction signal. Thus, the throttle moves in response to the electric control signal. In one embodiment, the electric control signal is an analog voltage and the output of the counter is first converted to an analog voltage output by an digital to analog converter.

It is one object of the invention, therefore, to provide a means of incorporating a stepper motor into a closed loop control system without the need for expensive and trouble prone position feedback sensors on the throttle. The up/down counter provides a virtual throttle position that may be used in a control loop in lieu of actual position feedback.

A decoder circuit may be associated with the up/down counter for detecting an overflow/underflow condition and setting the state of the up/down counter to a non overflow/underflow state.

It is thus another object of the invention to avoid control discontinuities resulting from overflows and underflows of the up/down counter when using an up/down counter to calculate a virtual throttle position.

The engine controller includes an engine speed sensor for producing a speed signal proportional to engine speed. A virtual throttle positioning circuit receives this speed signal and integrates the difference between a speed reference and this speed signal to produce a target throttle position signal. The stepper motor is moved in a direction that reduces the difference between the target throttle position and the virtual throttle position.

It is another object of the invention, to produce a controller suitable for use with an electro-mechanical actuator, such as a stepper motor, that does not start at a known "home" position. The virtual throttle positioning circuit ensures that the stepper motor will move in the correct direction to control the throttle even if the absolute position of the stepper motor is not known. The lack of a known "home" position of the stepper motor is thus accommodated.

The integrator may include a bypass means for changing the integrator time constant in response to certain predetermined engine conditions, such as start up, when the response of the virtual throttle positioning circuit must be increased.

It is thus a further object of the invention to permit the use of an integrator in the control system without degrading the system performance under such engine conditions.

The speed signal from the engine may be produced by a variable reluctance sensor reading the passage of teeth on a gear. The periodically varying signal produced by the sensor is received by a slope detector circuit which produces a digital timing signal.

It is yet another object of the invention to provide a means of detecting engine speed in the presence of stray magnetic fields associated with the engine which may bias the periodically varying signal up or down. The use of a slope detector provides a high degree of immunity to such biasing effects.

Other objects and advantages besides those discussed above will be apparent to those skilled in the art from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the full scope of the invention.

BRIEF DESCRIPTION OF THE DRAWINGS

FIG. 3 is a detailed schematic of the magnetic pickup circuitry of FIG. 2;

FIG. 4 is a detailed schematic of the differential integrator and associated start up bypass of the throttle control circuitry of FIG. 2 showing the adjustment of the differential integrator for starting conditions.

DESCRIPTION OF THE PREFERRED EMBODIMENT

Figure 1:
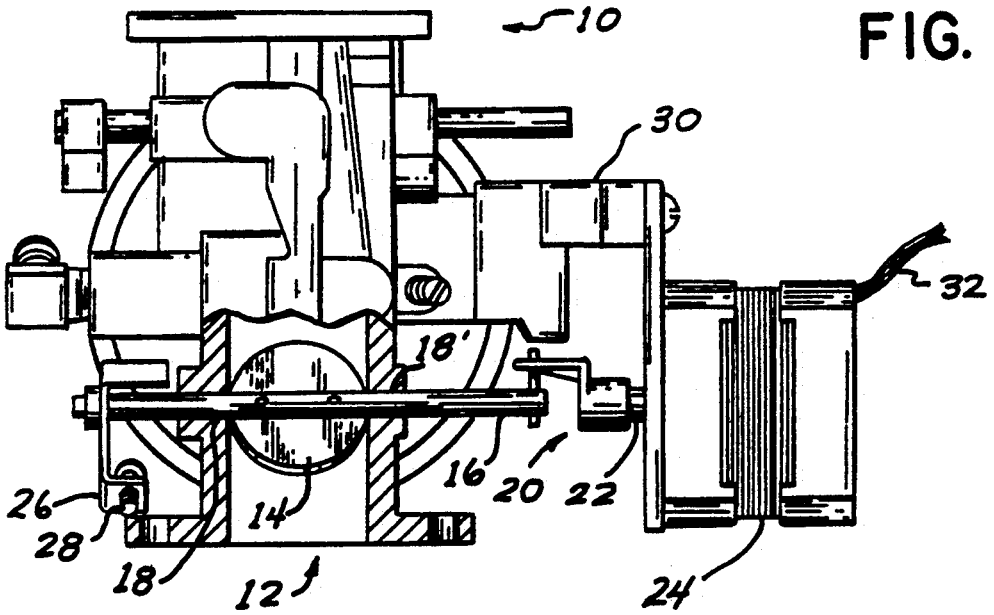
FIG. 1 is a perspective view of a throttle for an internal combustion engine with portions cut away to reveal the throttle plate and shaft, and showing the direct connection of the stepper motor to the throttle.

Referring to FIG. 1, a carburetor 10 such as used with an 18 HP 1800 RPM gasoline engine contains a cylindrical throat 12 for mixing and guiding a mixture of air and gasoline to the intake manifold (not shown). Within the throat 12 of the carburetor 10 is a disc-shaped throttle plate 14 mounted on a throttle shaft 16 so as to rotate the throttle plate 14 about a radial axis by 90° to open and close the throat 12 to air and gasoline flow. The shaft 16 is guided in its rotation by holes 18 in opposing walls of the throat 12 and the shaft 16 extends outside of the throat 12 through one such hole 18' so as to be externally accessible. The outward extending end of the shaft 16 is connected to a coupling 20 which in turn connects the shaft 16 to a coaxial shaft 22 of a stepper motor 24. The shaft 16 also supports a stop arm 26 extending radially from the shaft 16 and carrying an idle adjusting screw 28 facing circumferentially with respect to motion of the stop arm 26. The stop arm 26 serves to limit the rotation of the shaft 16 and throttle plate 14 within the throat 12 to control the idle and maximum opening of the carburetor 10, as is generally understood in the art. The idle speed may be adjusted by means of idle adjusting screw 28.

The stepper motor 24 is affixed to the carburetor 10 by means of a mounting bracket 30 which orients the stepper motor 24 so that its shaft 22 is coaxial with the throttle shaft 16 as described above. During assembly, the relative rotational position of the stepper motor 24 and throttle plate 14 need not be known. Thus, the need for careful alignment during manufacturing is avoided, as will be discussed below.

The stepper motor 24 is of a bidirectional design capable of stepping continuously in either direction with an angular resolution of 1.8° per step. The stepper motor 24 contains two windings controlled by four electrical leads 32 which may be independently connected with electrical power in a predetermined sequence to cause the stepper motor 24 to step by a predetermined amount. It will be apparent from the following discussion that other such stepper motors 24 may also be used.

It should be noted that no return spring is employed with the stepper motor 24 and hence the stepper motor 24 need only overcome the forces o the throttle shaft 16 resulting from pressure on the throttle plate 14 from air flow and the minimal resistance of friction between the throttle shaft 16 and the holes 18 in the throat 12. Accordingly, the stepper motor 24 may be less expensive and lighter than a comparable linear or rotary actuator. The speed of commercially available stepper motors 24 is dependent in part on the stepping resolution. Accordingly, there is a trade-off between throttle response time and positioning accuracy. As will be understood to one of ordinary skill in the art, depending on the application, stepper motors 24 having different numbers of steps per revolution and revolutions per second may be selected to tailor the stepper motor 24 to the requirements of accuracy and speed.

The direct coupling of the stepper shaft 22 to the throttle shaft 16, provides an improved transfer of torque between the stepper motor 24 the throttle shaft 16, however other connection methods may be used such as a four bar linkage as is generally known in the art.

As mentioned, the stepper motor 24 may start at any position and without a position sensor there is no indication of the current position of shaft 22 of the stepper motor 24. This lack of a fixed "home" position of stepper motor 24 simplifies manufacture of the carburetor because rotational alignment of the stepper shaft 22 and the throttle shaft 16 is not necessary. However, this feature of stepper motors 24 requires that special throttle controller circuitry be used.

Figure 2:
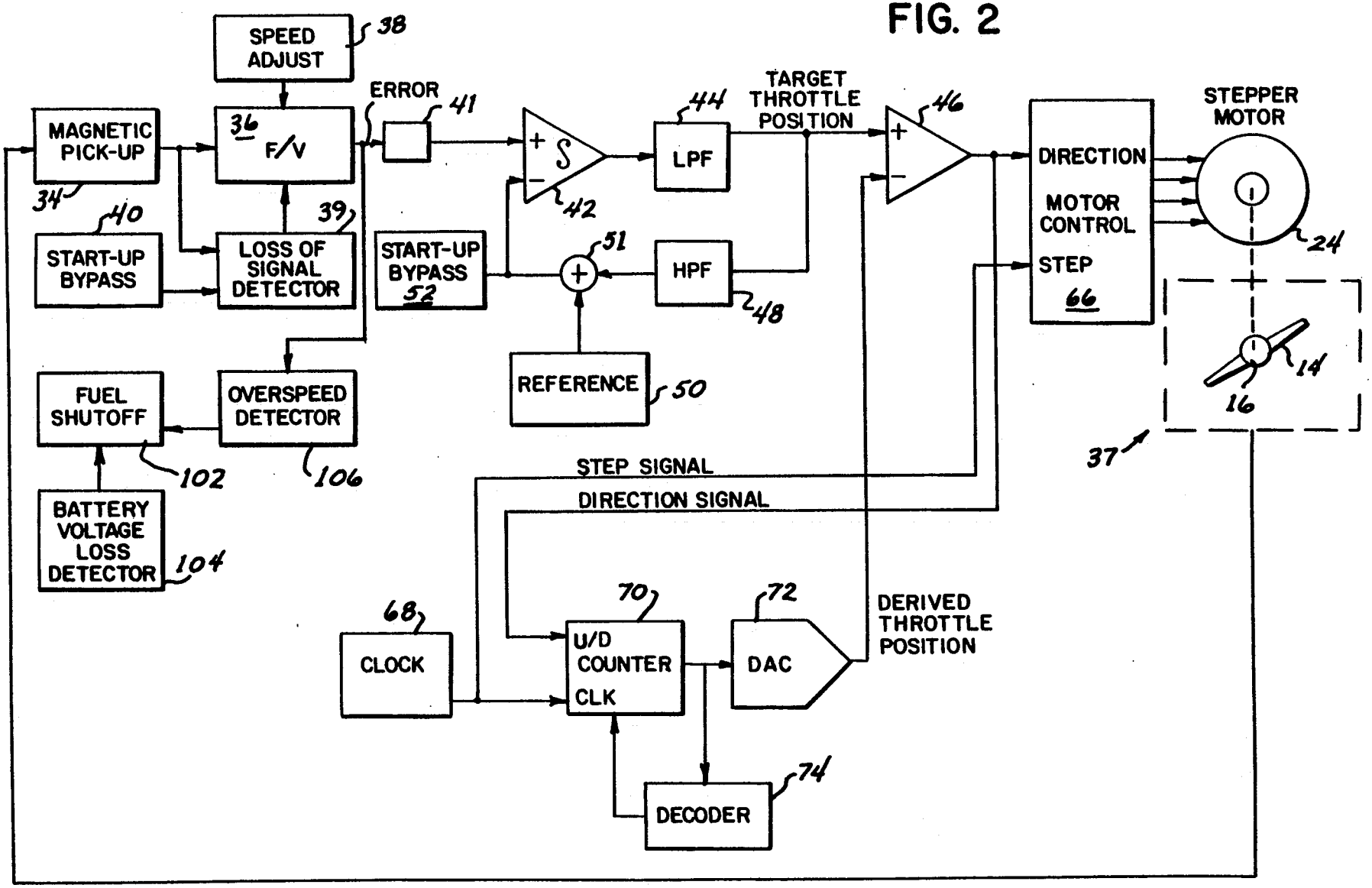
FIG. 2 is a block diagram of throttle control circuitry suitable for use with the stepper motor and throttle of FIG. 1.

Referring to FIGS. 2 and 3, an engine controller receives information on the speed of the engine 37 from a magnetic pick-up circuit 34 associated with a ring gear 43 on the engine flywheel. The magnetic pickup circuit 34 includes a variable reluctance type sensor 120 which produces a signal having a periodic waveform with a frequency proportional to the speed of the engine 37. Variable reluctance sensors operate generally by sensing changes in magnetic flux produced by the passage of magnetically permeable materials and therefore are sensitive also to external magnetic fields such as those produced by moving magnets associated with an engine magneto system or the generator itself. It has been determined that the signal produced by the sensor 120 may be offset by a significant voltage generated by the external field from magnets associated with the engine. This offset prevents the use of a simple comparator circuit to produce a reliable digital frequency signal from the sensor 120 signal.

For this reason, the sensor 120 signal is converted to a digital pulse train by means of a slope detecting circuit in the magnetic pickup circuit 34. Referring to FIG. 3, one lead of the variable reluctance sensor 120 is biased to a baseline voltage by resistors 122 and 124 connected together in a voltage divider configuration. The signal from the other lead of the sensor 120 is then clipped by series resistor 128 followed by zener diode 130 to ground. The clipped signal is received by series resistor 129 and biased to a reference voltage by resistors 132 and 134 also connected together in a voltage divider configuration. The now biased and truncated signal is received by the noninverting input of comparator 142 through resistor 136 and received by the inverting input of comparator 142 through a differentiator constructed of series resistor 138 followed by capacitor 140 to ground. The time constant of the differentiator will depend on the expected range of the frequency of the signal from sensor 120. The series resistor 129 together with resistors 132 and 134 prevent the noninverting input of the comparator 142 from receiving a negative voltage with respect to ground.

The output of the comparator 142 is thus dependent on the slope of the truncated and biased signal rather than the absolute level of this signal and hence the effects of baseline offsets in the sensor 120 signal caused by ambient magnetic fields are eliminated. Although the variable reluctance sensor 120 is preferred, other engine speed sensors may also be used including optical pick-ups that respond to patterns on rotating engine components. Alternatively, an electric signal may be derived directly from the ignition circuitry.

The output of the magnetic pick-up circuit 34 is thus a pulse train produced by comparator 142 with a frequency that is equal to that of the signal from the sensor 120. Referring again to FIG. 2, this output is received by a frequency-to-voltage converter 36 which produces a voltage inversely proportional to the engine speed and offset by a speed adjust voltage from potentiometer 38. Higher voltages output from the frequency-to-voltage converter 36 thus indicate lower engine speeds.

The signal from the magnetic pickup circuit 34 is received also by a loss-of-signal detector 39 which compares the average of the signal to a predetermined threshold to determine if there has been a failure of the sensor 120 or a break in the connecting wiring. If the signal level is below the predetermined threshold, then the loss-of-signal detector 39 increases the output of the frequency-to-voltage converter 36 to the supply voltage. This causes the control loop, to be described, to close the throttle, slowing the engine down. This loss-of-signal detector 39 is bypassed for a fixed time during the initial starting of the engine to prevent its overriding of the frequency-to-voltage converter 36 when the engine is first started. The bypassing circuit 40 is a resistor capacitor time delay triggered by the application of power to the control circuitry, as will be understood by one of ordinary skill in the art.

The voltage produced by the frequency-to-voltage converter 36 is attenuated by a gain block 41 and received by the non-inverting input of a differential integrator 42. The differential integrator 42 produces a rising or falling waveform of voltage depending on whether the voltage from the frequency-to-voltage converter 36 is above or below a reference value applied to the inverting input of the differential integrator 42 as will be explained. The output from the differential integrator 42 is filtered by low-pass filter 44 to reduce noise and for stability reasons and this signal, termed the "target throttle position" is applied both to the positive input of a comparator 46 and to the input of a high pass filter 48.

The output of the high pass filter 48 is summed with a reference voltage 50 which then provides the reference value applied to the inverting input to the differential integrator 42. The purpose of the high pass filter 48 is to improve the stability of the control loop as will be understood to those of ordinary skill in the art. The output of the frequency to voltage converter 36 may be offset by either changing the speed adjust 38 or the reference voltage 50. Generally, the reference voltage 50 is fixed at the time of manufacture and the speed adjust 38 is available to the user.

The slew rate of the voltage waveform produced by the differential integrator 42 is a function of the integrator time constant and generally fixes that maximum rate of change in the position of the throttle plate 14. During the starting of the engine, when the rate of change of the engine speed and the position of the throttle plate 14 is large, the time constant is reduced to zero. This is accomplished by a start-up bypass circuit 52 similar to the one used with the loss-of-signal detector 39 For a predetermined time after the engine is started, the time constant of the differential integrator 42 is held at zero, after which it returns to its predetermined value.

Referring to FIG. 4, the differential integrator 42 is comprised of an operational amplifier 54 having an integrating capacitor 56 connected in a feedback path from the output of the operational amplifier 54 to its inverting input and an input resistor 58 tied to its inverting input, so as to integrate current though input resistor 58, as is known in the art. The integrating capacitor 56, together with the input resistor 58 determines the time constant of the differential integrator 42.

Also connected to the inverting input of operational amplifier 54 is the input from high pass filter 48 as has been described.

The input resistor 58 is shunted by a solid state switch 60 which when closed, shorts the input resistance 58 to create essentially zero input resistance and hence a time constant of zero. The solid state switch 60 is controlled by a timing circuit in the start up bypass 52 comprised of a capacitor 62 with one end connected to the power supply line for the engine controller, and the other end connected through a resistor 64 to ground. The control line of the switch 60 is attached to the junction between the capacitor 62 and the resistor 64. When the engine is first started and the power to the engine controller is turned on, the power supply voltage is applied to one end of the capacitor 62. Instantaneously, the junction between the capacitor 62 and the resistor 64 is raised to the supply voltage and the switch 60 is closed disabling the time constant of the differential integrator 42 as described. Resistor 64 then discharges capacitor 62 opening switch 60 and increasing the time constant to the value determined by input resistor 58 and capacitor 56.

The non-inverting input of the operational amplifier 54 is connected to the center tap of potentiometer 45 within gain block 41 which receives the signal from the frequency to voltage converter 36 on one end tap. The remaining tap is connected to the junction of reference 50 and input resistor 58, through a resistor 53, to provide the current integrated by the operational amplifier 54.

Referring again to FIG. 2, the output from the low-pass filter 44 following the differential integrator 42 provides a target throttle position and is input to the non-inverting input of comparator 46 where it is compared to a "virtual throttle position" which will be described further below. The comparator 46 produces a binary digital signal, termed the direction signal, which is positive if the target throttle position signal is greater than the virtual throttle position signal and zero if the reverse is true.

A stepper sequence controller 66 accepts this direction signal as its direction input. The stepper sequence controller 66 also has a step input which is connected to a free running oscillator 68 which produces a stream of continuous step pulses. The stepper sequence controller 66 processes the direction input and the step input and produces the correct winding current for the stepper motor 24 to move the stepper motor shaft 22 in the direction of the direction input by the number of steps received at the step input. The stepper motor 24 thus steps constantly, but as will be understood from the following discussion, the virtual throttle position moves with the stepping of the stepper motor 24 and hence if the target throttle position is near the virtual throttle position, the direction signal will constantly change and the stepper motor 24 will step back and forth near the desired throttle position thus tracking the voltage produced by the differential integrator 42. The stepping back and forth of the stepper motor 24 produces an average throttle 14 opening halfway between each pair of step positions and eliminates position error that would result from incorporation of a "dead band" circuit to suppress stepping of the stepper motor 24 for throttle position errors of several steps. The constantly stepping stepper motor 24 also reduces the complexity of the throttle controller.

The virtual throttle position is produced by tallying the number of steps and the direction of the steps. This is done by means of an up/down counter 70 having its clock input connected to the clock signal from the free running oscillator 68 and the up/down line connected to the direction signal from the comparator 46. The up/down line is also received by the sequencer circuit 66 which in turn rotates the stepper motor 24 and throttle plate 14 in the proper direction and by the proper number of steps. The digital word output by the up/-down counter 70 is converted into the analog virtual throttle position by an analog-to-digital converter 72 and the virtual throttle position signal is connected to the inverting input of comparator 46 as previously described.

The initial position of the stepper motor shaft 16 and hence the initial position of the throttle plate 14, as mentioned, is not known. This raises two problems:

The first is that the output of the up/down counter 70 may "wrap around", that is overflow or underflow while the throttle plate 14 is positioned within its range of travel prior to the its reaching either the fully open or the fully closed position. This wrap around will abruptly change the virtual throttle position signal by the full range of the output of the up/down counter 70 causing a disruption of the engine control loop.

The second problem is that there is no correlation between the virtual throttle position and the actual throttle position when the circuit is first energized because of the characteristics of the stepper motor 24 previously described.

The wrap around problem is addressed by means of decoder 74 which detects incipient overflow and underflow of the up/down counter 70 and resets the up/-down counter 70 to a state prior to incipient overflow or underflow state. This resetting is continued until the direction of the step is reversed and the up/down counter 70 moves away from the overflow or underflow condition without intervention by the decoder 74.

Figure 5:
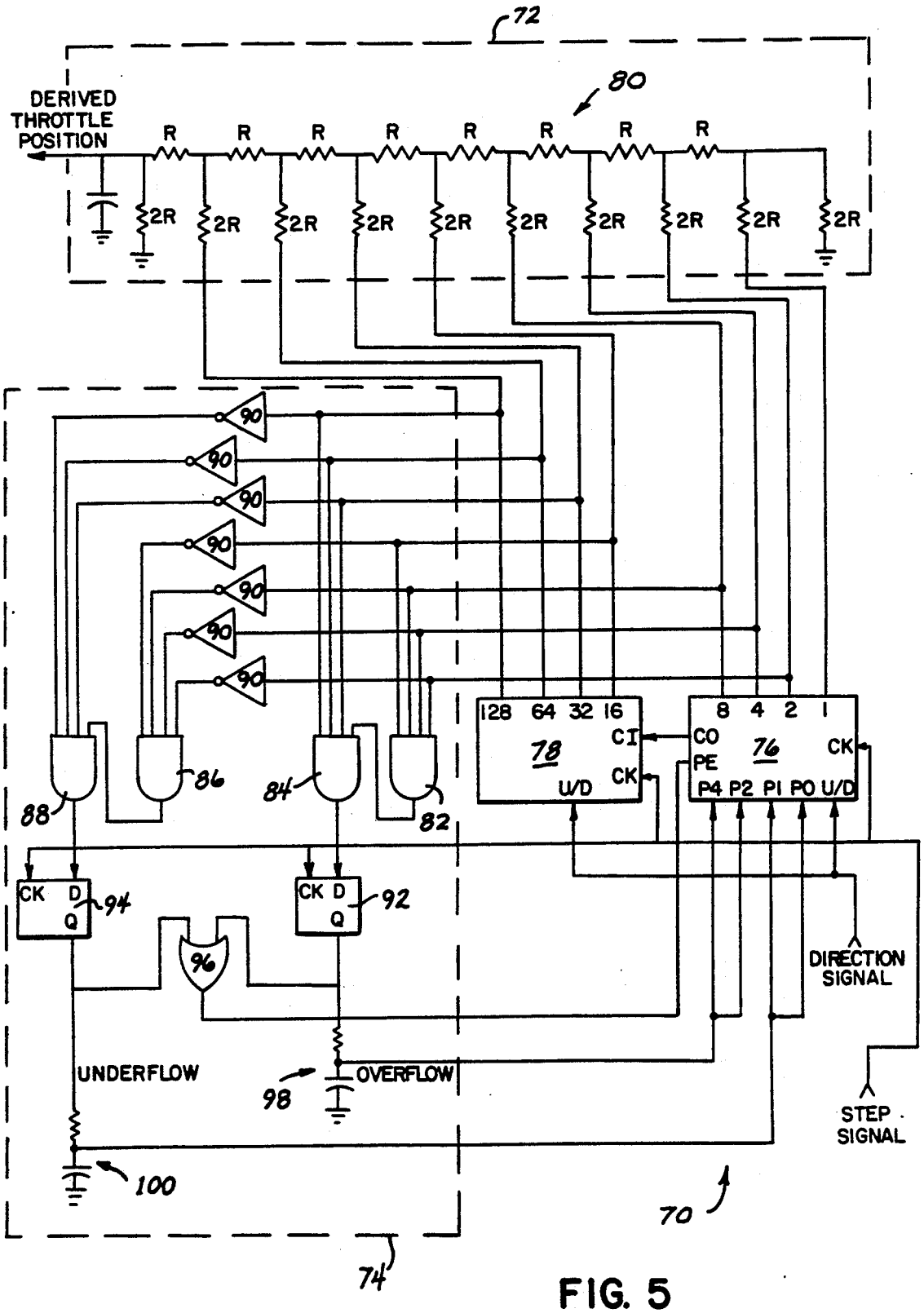
FIG. 5 is a detailed schematic of the interconnection of an up/down counter, decoder, and DAC of the throttle control circuitry of FIG. 2 showing the generation of an analog "virtual throttle position" and showing the use of the decoder to prevent "wrap around" errors.

Referring to FIG. 5, the up/down counter 70 comprises two four bit up/down counters 76 and 78 connected by means of the carry in and carry out lines to form the single 8 bit synchronous up/down counter 70 having binary outputs 1, 2, 4, 8 . . . 128. Counter 76 provides the least significant four bits and counter 78 provides the most significant four bits. The up/down counter 70 is clocked by the clock signal and the direction of the count is determined by the direction signal attached to the up/down input of the counters 76 and 78. The outputs of the counters 76 and 78 drive a resistor ladder 80 which forms the digital-to-analog converter 72 and creates the analog virtual throttle position signal as has been described The 2, 4, 8 and 16 binary outputs of counters 76 and 78 are connected to the inputs of a four input AND gate 82 of decoder 74. The output of the AND gate 82 together with binary outputs 32, 64 and 128 of counter 78 are connected to the inputs of four input AND gate 84. The output of AND gate 84, therefore, is high if the binary output of the counters 76 and 78 are at 1111 111x, termed the overflow condition (where x indicates a don't care state per standard convention).

The seven most significant binary outputs of the counters 76 and 78 are also inverted by inverters 90 and connected in a similar fashion to AND gates 86 and 88 to logically AND the seven outputs. The output of AND gate 88 will be high if the binary output of the counters is at 0000 000x, termed the underflow state.

The overflow and underflow signals from AND gates 84 and 88 are input to D flip-flops 92 and 94, respectively, where they are clocked by the clock signal to the outputs of the D flip-flops 92 and 94 respectively to properly synchronize them with the counters 78 and 76 as will be described. The synchronized overflow and underflow signals from the outputs of D flip-flops 92 and 94 are input to OR gate 96 whose output is used to drive the preset enable input to counter 76 associated with the least significant outputs of the up/down counter 70. The underflow signal is connected through a resistor/capacitor time delay network 98 to the 1 and 2 preset inputs of counter 76. The overflow signal is connected through a resistor/capacitor time delay network 100 to the 4 and 8 preset inputs of counter 76.

If an underflow condition has been detected, the preset enable input of counter 76 is activated, the preset inputs I and 2 are held high by the underflow signal, and the preset enable lines 4 and 8 are held low by the overflow signal to force the outputs 1 and 2 of the counter 76 high and the outputs 4 and 8 of the counter 76 low. Thus the incipient underflow condition 0000 000x of counter 76 is forced to 0000 0011. This prevents underflow of counter 76 if the next clock signal is associated with the down counting direction. If the direction line remains in the down counting direction, the counter 76 will simply toggle between 0000 000x and 0000 0011 without wrapping around.

Conversely, if an overflow condition has been detected, the preset enable input of counter 76 is activated, the preset inputs 1 and 2 are held low and the presets 4 and 8 are held high by the overflow signal from D-flip-flop 94 to force the outputs I and 2 of the counter 76 low and the outputs 4 and 8 of the counter 76 high. Thus the incipient overflow condition 1111 111x of counter 76 is forced to 1111 1100. This prevents overflow if the next steps signal is associated with a the up counting direction. Again, if the direction line remains in the up counting state, the counter 76 will simply toggle between 1111 111x and 1111 1100 without wrapping around. The action of the decoder 74 is thus to create a barrier preventing the up/down counter 70 from overflowing or underflowing during operation.

It should be noted that even though the up/down counter 70 does not progress during an overflow or underflow state, the step pulses are still moving the stepper motor 24 thus bringing the stepper motor 24 and virtual throttle position from up/down counter 70 further into alignment.

Thus the second problem of using a stepper motor 24, that of reconciling the virtual throttle position to the actual throttle position, is solved for the situation where in the direction of the movement of the throttle plate 14, the virtual throttle position is ahead of the actual throttle position. In this case, the up/down counter 70 ultimately reaches a wrap-around point and waits for the stepper motor 24 and the actual throttle position to catch up.

In the converse situation where in the direction of throttle movement, the actual throttle position leads the virtual throttle position, the throttle shaft 16 will ultimately be restrained by stop arm 26 and the stepper motor 24 will stall until the virtual throttle position catches up with the actual throttle position. In either situation, the operation of the control circuitry is to reduce any initial difference between and the actual and the virtual throttle position so that the virtual throttle position provides and accurate representation of the position of the throttle plate 14 for use in feedback control.

Referring to FIG. 2, the throttle controller uses two principle feedback paths: the first is the signal from the magnetic pickup circuit 34 which feeds back a real time indication of the engine speed, and the second is the up/down counter 70 which tracks, via virtual throttle position, any change in the target throttle position.

Referring again to FIGS. 1 and 2, the elimination of the retraction spring, used in linear or rotary actuators, means that in the event of an electrical failure, for example, loss of battery power, the stepper motor 24 will not return the throttle plate 14 to a closed position as is desired. Accordingly, referring again to FIG. 2, a fuel shutoff solenoid 102 is placed in the engine fuel line (not shown) feeding the carburetor. This fuel shutoff solenoid 102 is activated in the event that battery voltage is lost, as detected by a battery voltage loss detector 104, or if the speed voltage from the frequency-to-voltage converter 36 indicates that the engine is running at or above a maximum predetermined speed as determined by overspeed detector 106. Both the overspeed detector 106 and the battery voltage loss detector 104 are comprised of a comparator as is known in the art and are latched to prevent reactivation of the engine as engine speed drops.

Components Appendix

| Description and Ref. No. | Vendor |
|---|---|
| Stepper sequence controller 66 | L297/1 SGS Thomson |
| Counters 76, 78 | CD4516 COS/MOS Presettable Up/Down Counter; Motorola |
| Stepper motor 24 | Oriental Motor |

The above description has been that of a preferred embodiment of the present invention. It will occur to those who practice the art that many modifications may be made without departing from the spirit and scope of the invention. For example, the controller could be used with engines without carburetors where the stepper motor controls the setting of an injector pump or the like. Also, the speed adjust 38 could be remotely mounted and used to vary the engine speed. In order to apprise the public of the various embodiments that may fall within the scope of the invention, the following claims are made.

We claim:

1. In an engine regulator for an internal combustion engine having a stepper motor for controlling the flow rate of air and fuel in response to a electric control signal, a controller for providing step pulses to the stepper motor in response to the electric control signal, the controller comprising:

an oscillator for producing a periodic clock signal;

a sequencer for receiving a direction and the clock signal for producing step pulses for moving the stepper motor in a direction for a predetermined number of steps;

an up/down counter for receiving the direction and clock signals and producing a digital word updated in the direction indicated by the direction signal and in amount by a number indicated by the clock signal; and a comparator for comparing the digital word to the electric control signal and producing the direction signal.

2. The regulator of claim 1 wherein the electric control signal is an analog signal and the comparator includes a digital to analog converter for converting the digital word to an analog position value and wherein the comparator compares the analog position value to the electric control signal.

3. An engine regulator for an internal combustion engine having a stepper motor for controlling the flow rate of air and fuel in response to a electric control signal, a stepper motor controller comprising:

a speed reference;

an engine speed sensor for producing a speed signal proportional to engine speed;

a virtual throttle positioning circuit an integrator for integrating the difference between the speed reference and the speed signal to produce an throttle position signal;

a stepper motor sequencer for receiving an error signal and stepping the stepper motor to reduce the error signal;

a movement tracking means responsive to the error signal for producing a virtual throttle position signal;

a comparator means for producing the error signal from the virtual throttle position signal and the throttle position signal.

4. The stepper motor controller of claim 3 including an integrator bypass means for changing the integrator time constant in response to a predetermined engine condition.

5. The stepper motor controller of claim 3 wherein the predetermined engine condition is the starting of the engine.

6. The stepper motor controller of claim 3, including a fuel cut-off means for shutting off the fuel to the carburetor independently of the throttle position if there is a loss of battery signal.

7. In engine regulator for an internal combustion engine having a stepper motor for controlling the flow rate of air and fuel, a stepper motor feedback system comprising:

a free running oscillator for producing periodic clock signal;

a sequencer for receiving a direction signal and the clock signal for producing step pulses for moving the stepper motor in a direction for a predetermined number of steps;

an up/down counter for receiving the direction signal and the clock signal and producing a digital word updated in the direction indicated by the direction signal and in the amount indicated by the clock signal;

a decoder circuit for detecting an overflow/underflow digital word from the up/down counter and setting the state of the up/down counter to a non overflow/underflow state; and a comparator for comparing the digital word to the electric control signal and producing the direction signal.

8. The stepper motor feedback system of claim 7 wherein the periodic clock signal is continuous.

* * * * *

UNITED STATES PATENT AND TRADEMARK OFFICE

CERTIFICATE OF CORRECTION

PATENT NO. : 5,003,948

DATED : April 2, 1991

INVENTOR(S) : Jonathan D. Churchill and William T. Volmary

It is certified that error appears in the above-identified patent and that said Letters Patent is hereby corrected as shown below:

Column 10, line 45 "circuit" should be --circuit comprising:--

Signed and Sealed this

Eighth Day of September, 1992

*Attest:*

DOUGLAS B. COMER

*Attesting Officer*

*Acting Commissioner of Patents and Trademarks*